US009677369B2

(12) United States Patent
Welsh et al.

(10) Patent No.: US 9,677,369 B2
(45) Date of Patent: Jun. 13, 2017

(54) CARTRIDGE INSERT FOR SPOOLS

(71) Applicant: Cameron International Corporation, Houston, TX (US)

(72) Inventors: Kyle R. Welsh, Calgary (CA); Dwayne C. Raynard, Calgary (CA)

(73) Assignee: Cameron International Corporation, Houston, TX (US)

( * ) Notice: Subject to any disclaimer, the term of this patent is extended or adjusted under 35 U.S.C. 154(b) by 672 days.

(21) Appl. No.: 14/143,910

(22) Filed: Dec. 30, 2013

(65) Prior Publication Data

US 2015/0184480 A1 Jul. 2, 2015

(51) Int. Cl.
*E21B 33/04* (2006.01)
*E21B 19/22* (2006.01)

(52) U.S. Cl.
CPC ..... *E21B 33/0422* (2013.01); *E21B 19/22* (2013.01)

(58) Field of Classification Search
CPC ..... E21B 33/0422; E21B 19/22; E21B 33/04; E21B 33/0415; E21B 33/047; E21B 33/03
See application file for complete search history.

(56) References Cited

U.S. PATENT DOCUMENTS

| | | | | |
|---|---|---|---|---|
| 2,824,757 | A * | 2/1958 | Rhodes | E21B 33/0422 166/88.3 |
| 4,790,379 | A | 12/1988 | Vanderford | |
| 5,544,706 | A * | 8/1996 | Reed | E21B 33/0422 166/105 |
| 5,727,631 | A | 3/1998 | Baker et al. | |
| 5,799,730 | A | 9/1998 | Lam et al. | |
| 6,192,981 | B1 | 2/2001 | Boquet et al. | |
| 2003/0042027 | A1 | 3/2003 | Lang et al. | |
| 2003/0051884 | A1 | 3/2003 | Card et al. | |

* cited by examiner

*Primary Examiner* — Wei Wang
(74) *Attorney, Agent, or Firm* — Eubanks PLLC

(57) ABSTRACT

A system for holding a tubular string in a well is provided. In one embodiment, the system includes a cartridge having a body that can be installed within a wellhead spool attached to a well, and the cartridge includes slips and a setting ring that are disposed within a bore of the body. The slips and the setting ring are retained within the bore of the body and are axially movable within the body such that, when installed within the wellhead spool, the slips are retained in a retracted position when the setting ring is in a first axial position within the body and the slips contract inwardly when the setting ring is moved to a second axial position. Additional systems, devices, and methods are also disclosed.

19 Claims, 5 Drawing Sheets

CARTRIDGE INSERT FOR SPOOLS

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

In order to meet consumer and industrial demand for natural resources, companies often invest significant amounts of time and money in finding and extracting oil, natural gas, and other subterranean resources from the earth. Particularly, once a desired subterranean resource such as oil or natural gas is discovered, drilling and production systems are often employed to access and extract the resource. These systems may be located onshore or offshore depending on the location of a desired resource. Further, such systems generally include a wellhead assembly mounted on a well through which the resource is accessed or extracted.

These wellhead assemblies may include a wide variety of components, such as casing heads, tubing heads, and devices for hanging tubular strings (e.g., casing) within the well. For example, casing strings of different diameters in the well can be suspended from respective casing hangers installed in a wellhead. In some applications, it may be desirable to also hang a coiled tubing string in a well. For instance, a coiled tubing string can be run into a producing gas well to address liquid-loading issues downhole, facilitating extraction of liquids from the well so as to promote gas production. Certain previous techniques for hanging coiled tubing strings in wells include using grapple assemblies that tie back to tubing hangers, while others include setting slips through work windows in wellhead assemblies.

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

Embodiments of the present disclosure generally relate to a cartridge insert that can be installed in a wellhead, such as within the bore of a wellhead spool, to facilitate hanging of a tubular string (e.g., a coiled tubing string) within a well. In one embodiment, the cartridge includes slips for gripping the tubular string and a setting ring used to actuate the slips. When installed in the wellhead, set pins extending into the bore of the wellhead engage the setting ring to push the slips into a retracted position, allowing the tubular string to move freely (e.g., into the well) through the slips and the cartridge. The set pins can then be retracted to cause the setting ring to fall and the slips to contract into engagement about the tubular string.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein.

DETAILED DESCRIPTION OF SPECIFIC EMBODIMENTS

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Moreover, any use of "top," "bottom," "above," "below," other directional terms, and variations of these terms is made for convenience, but does not require any particular orientation of the components.

Figure 1:
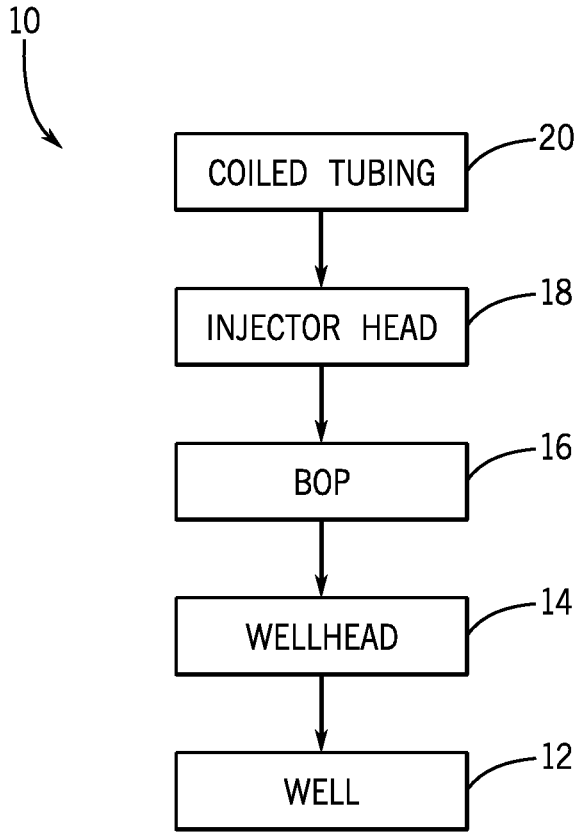
FIG. 1 generally depicts a production system having an injector head for running coiled tubing into a well through a blowout preventer and a wellhead in accordance with one embodiment of the present disclosure.

Turning now to the present figures, a system 10 is illustrated in FIG. 1 in accordance with one embodiment. Notably, the system 10 is a production system that facilitates extraction of a resource, such as natural gas or oil, from a reservoir through a well 12. A wellhead 14 is installed at the well (e.g., attached to the top of casing and tubing strings in the well). In one embodiment, the wellhead 14 includes a casing head and a tubing head, which can also be referred to individually as a casing spool and a tubing spool or collectively as wellhead spools. But the components of the wellhead 14 can differ between applications, and such equipment could include various casing heads, tubing heads, stuffing boxes, pumping tees, and pressure gauges, to name only a few possibilities.

The system 10 can include various well-control equipment, such as the blowout preventer 16 generally depicted in FIG. 1. As will be appreciated, the blowout preventer 16 can be used to close off the top of the well 12. In various embodiments, the blowout preventer includes a ram-type preventer or an annular preventer. Of course, the blowout preventer 16 can also be provided as a blowout preventer stack having multiple blowout preventers (e.g., multiple ram-type preventers and an annular preventer).

As depicted in FIG. 1, the system 10 also includes an injector head 18 coupled to the blowout preventer 16 to enable a coiled tubing 20 to be run into the well 12. In at least some embodiments, the coiled tubing 20 is wound around a reel and gradually fed from the reel into the injector head 18. The injector head 18 can include a gooseneck that guides the coiled tubing 20 into alignment with the body of the injector head as the coiled tubing 20 is fed into the well 12. Although not depicted in FIG. 1, the system 10 can also include a stripper assembly below the injector head 18 for sealing about the coiled tubing 20 and isolating the well pressure.

Figure 2:
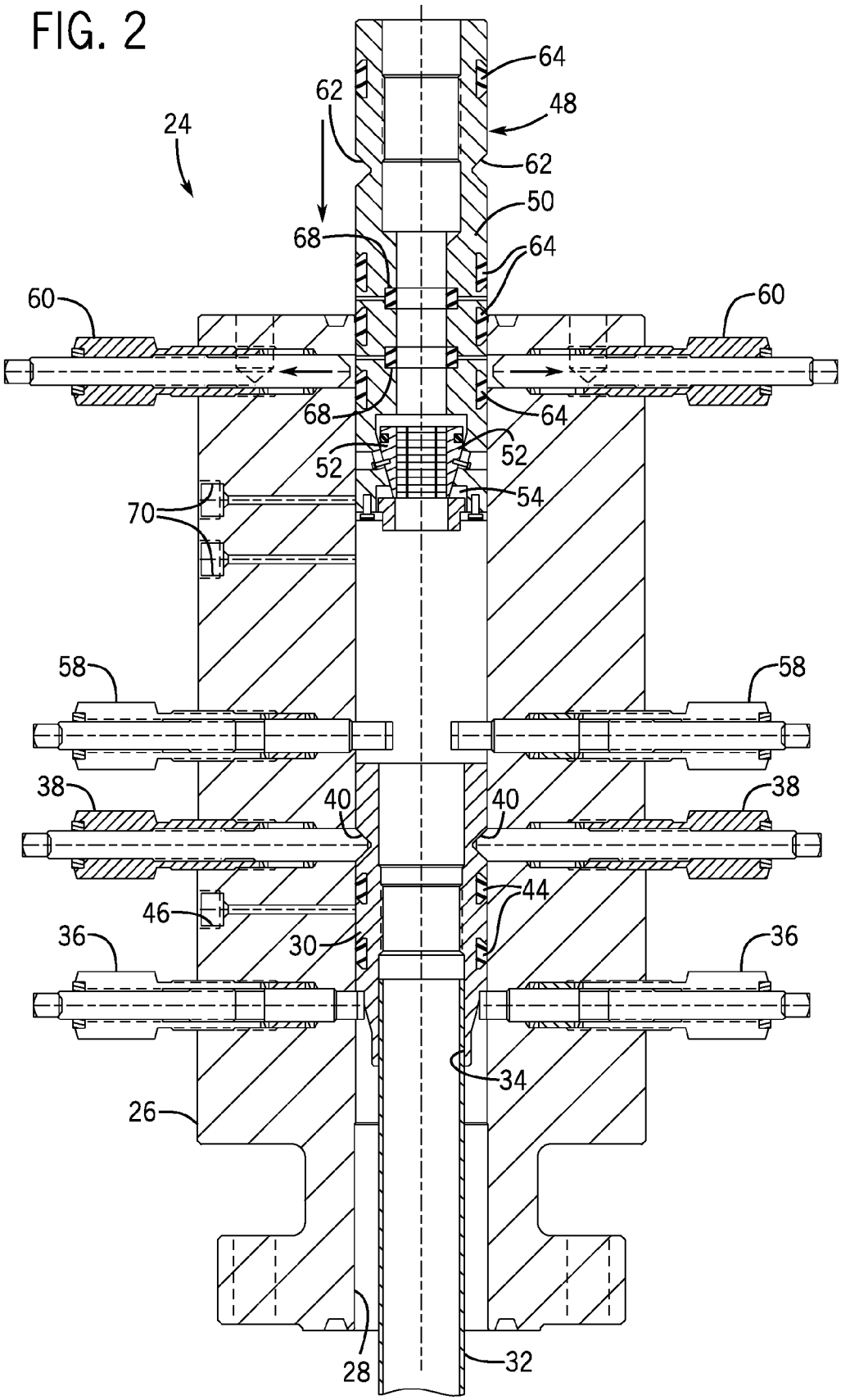
FIG. 2 is a cross-section of a tubing head having a bore that receives a cartridge with slips for holding a coiled tubing string or other tubular string in accordance with one embodiment.
Figure 3:
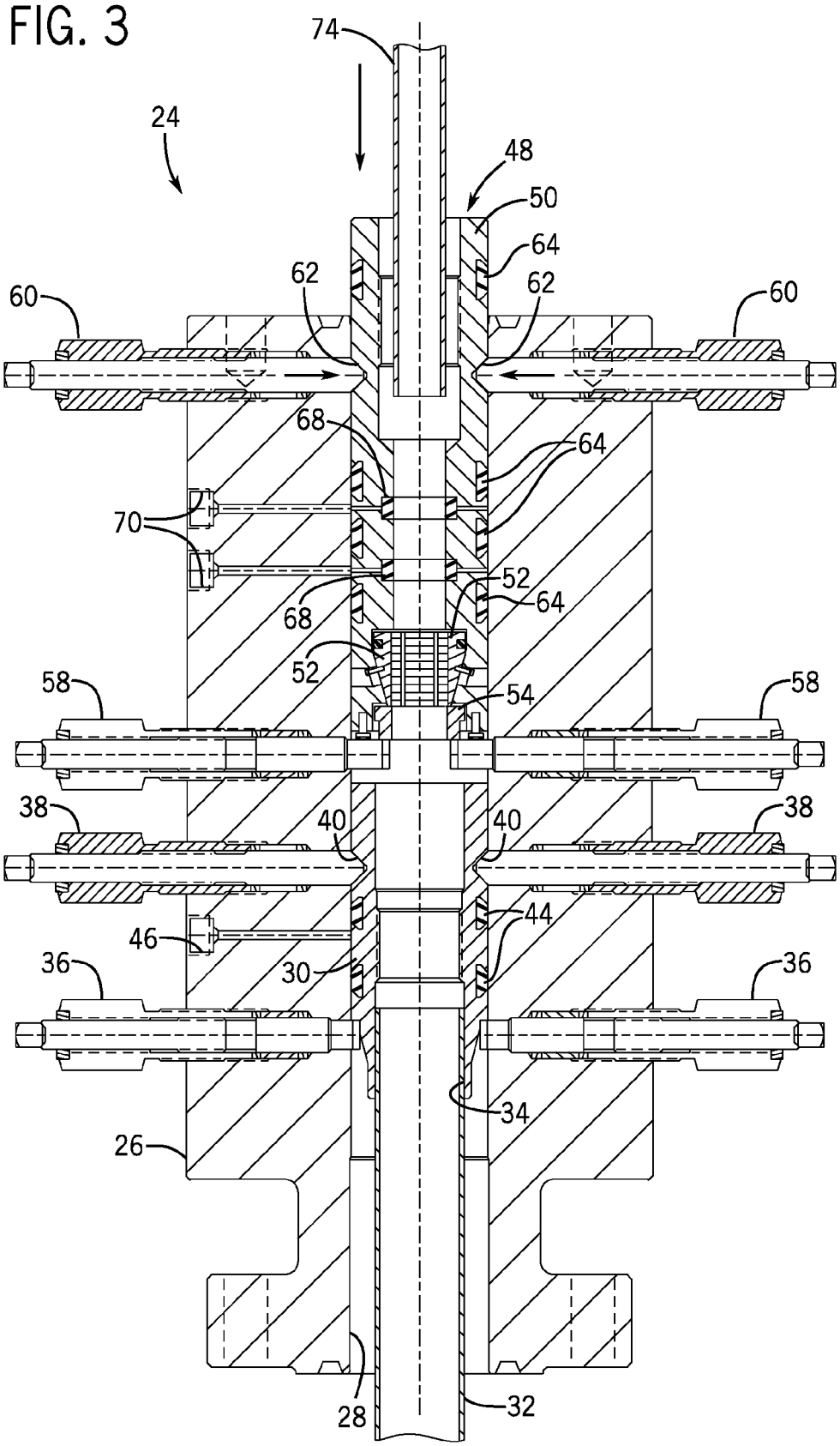
FIG. 3 depicts installation of the cartridge of FIG. 2 into the tubing head and into engagement with set pins extending into the bore of the tubing head in accordance with one embodiment.
Figure 4:
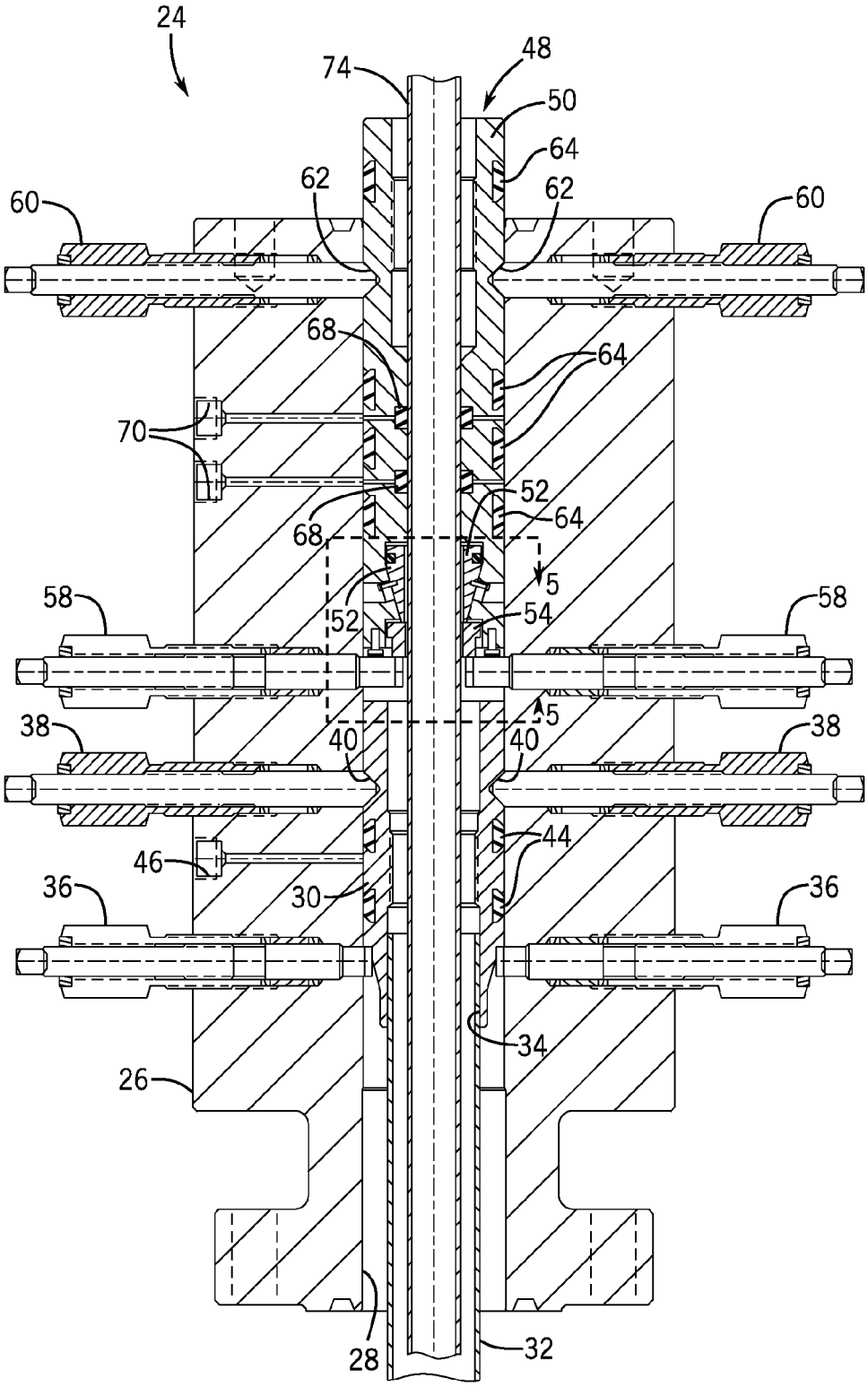
FIG. 4 depicts running of the coiled tubing string into the well through the cartridge and the tubing head in accordance with one embodiment.

In one embodiment generally depicted in FIGS. 2-4, a portion 24 of the system 10 includes a tubing head 26 of the wellhead 12. A tubing hanger 30 is installed in the bore 28 of the tubing head 26. A tubing string 32 is connected to the tubing hanger 30 by a threaded connection 34 such that the tubing string 32 is suspended in the well 12 from the tubing hanger 30. The tubing hanger 30 is supported within the bore 28 by set pins 36 provided through the tubing head 26. Locking pins 38 can be extended into one or more recesses 40 in the outer surface of the tubing hanger 30 to inhibit upward movement of the tubing hanger 30. The one or more recesses 40 can be provided as a single circumferential groove about the tubing hanger 30 or as multiple discrete indentations that can be aligned with the locking pins 38. Seals 44 inhibit the flow of fluid between the tubing hanger 30 and the tubing head 26. While the presently depicted tubing head 26 includes just a single tubing hanger 30, in other embodiments the tubing head 26 could have multiple hangers 30.

In addition to the tubing hanger 30 and its suspended tubing string 32, a cartridge 48 is provided to facilitate the installation of another tubular string 74 (FIG. 3). In at least one embodiment, the tubular string 74 is a coiled tubing string. It may be appreciated that such a coiled tubing string can be used in the well 12 (e.g., a gas well) as a velocity string that facilitates transport of liquids from the wellbore. The cartridge 48 includes a hollow main body 50 with slips 52 and a setting ring 54 provided within a bore of the main body. When installing the cartridge 48 in the bore 28 of the tubing head 26, the cartridge 48 may be inserted in an upper end of the bore 28 and then moved down to engage set pins 58 provided through the tubing head 26. Locking pins 60 can then be inserted into one or more recesses 62 about the exterior of the main body 50 of the cartridge 48. Like with the tubing hanger 30, the one or more recesses 62 can be provided as a single circumferential groove or as multiple indentations on the outer surface of the main body 50.

The cartridge 48 further includes outer seals 64 for inhibiting fluid flow between the cartridge 48 and the tubing head 26. The outer seals 64 are generally depicted as dovetail seals, but any suitable seals (in any suitable number) could instead be used. The cartridge 48 also includes inner seals 68 for sealing against the tubular string 74 run through the cartridge 48. In the presently depicted embodiment, the inner seals 68 are energized by applying pressure via the fluid ports 70. The inner seals 68 can also include any suitable types of seals capable of sealing against the tubular string 74.

Figure 5:
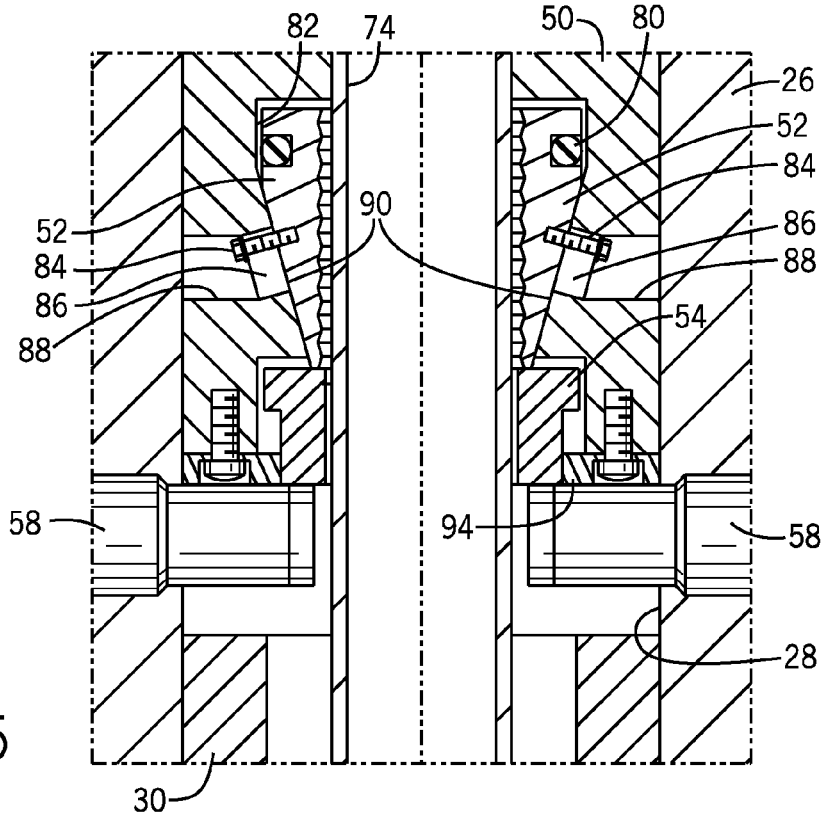
FIG. 5 is a detail view showing the slips of the cartridge held in a retracted position by a setting ring resting on set pins in accordance with one embodiment.
Figure 6:
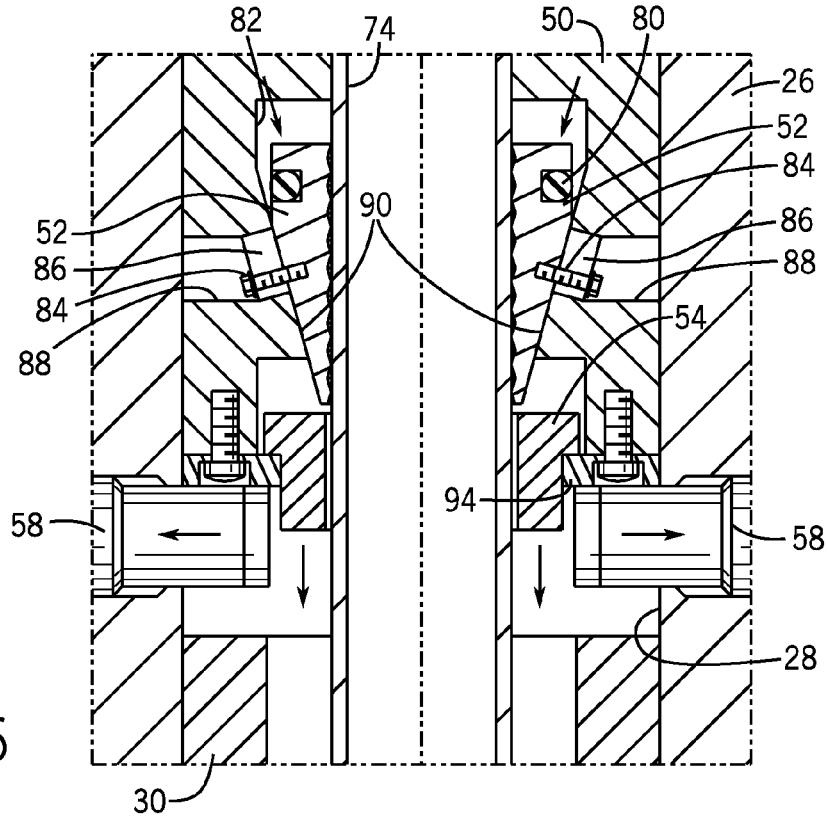
FIG. 6 generally depicts the slips having radially contracted to engage the coiled tubing string after the set pins are retracted to allow the setting ring to move downwardly within the cartridge in accordance with one embodiment.

Operation of the slips 52 to grip the tubular string 74 may be better understood with reference to FIGS. 5 and 6. Particularly, FIG. 5 depicts the slips 52 provided in a retracted position that allows the tubular string 74 to move freely through the cartridge 48. In contrast, FIG. 6 depicts the slips 52 having contracted inwardly to grip the tubular string 74. This allows the tubular string 74 to be suspended from the slips 52 while extending down into the well 12.

In the present embodiment, the cartridge 48 includes four slips 52 spaced about the central bore of the main body 50, though other embodiments could have a different number of slips. As depicted, the slips 52 have knurled inner surfaces that facilitate gripping of the tubular string 74 when the slips 52 are closed about the tubular string 74. The slips 52 are also connected with a ring 80 (e.g., an elastomeric ring) that maintains axial alignment of the slips 52 with one another inside a cavity 82 of the main body 50.

As the cartridge 48 is installed in the bore 28 of the tubing head 26, the set pins 58 engage the setting ring 54 and push it toward the slips 52. This causes the slips 52, which are depicted as resting on the setting ring 54, to rise within the cavity 82. The slips 52 are also connected to the main body 50 of the cartridge 48 by fasteners 84 extending through slots 86. These fasteners 84 can be installed in the cartridge 48 through the access ports 88. For example, the fasteners 84 can be provided as screws inserted into the access ports 88 and then threaded into outer surfaces of the slips 52 through the slots 86. With the diameter of the heads of the screws being larger than the width of the slots 86, the screws retain the slips 52 within the cavity 82.

In at least some embodiments, such as that depicted in FIGS. 5 and 6, the slips 52 have wedge-shaped profiles with tapered outer surfaces. The cavity 82 includes a mating, tapered surface 90. Due to the mating tapered surfaces of the cavity 82 and the slips 52, the fasteners 84 cause the slips 52 to retract away from the center of the bore of the main body 50 as the slips 52 are pushed upward into the cavity 82 by the setting ring 54.

Consequently, when the setting ring 54 is moved into a first axial position within the body 50 generally depicted in FIG. 5, such as by engagement with the set pins 58, the slips 52 move into a retracted position that allows the tubular string 74 to pass through the cartridge 48 between the inner surfaces of the slips 52. For example, once the cartridge 48 is installed in the tubing head 26, the tubular string 74 may be run into the well 12 through the cartridge 48 and through other components positioned over the well (e.g., the rest of the wellhead 14, the blowout preventer 16, and the injector head 18).

Once the tubular string 74 is positioned in the well, the slips 52 can be engaged so as to grip and support the weight of the tubular string 74. More specifically, as generally depicted in FIG. 6, in at least some embodiments the set pins 58 can be retracted to cause the setting ring 54 to move axially within the bore of the main body 50 toward the well to a second axial position. The slips 52 are actuated by this movement of the setting ring 54; thus, the ring 54 can also be referred to as an actuating ring. The slips 52 are actuated by the ring 54 in that the tapered surface 90 of the cavity 82 biases the slips 52 inwardly to close about and grip the tubular string 74 as the slips 52 move downward in response to movement of the setting ring 54 to the second axial position depicted in FIG. 6.

Additionally, at least some embodiments include a retaining ring 94. In such embodiments, assembly of the cartridge 48 can include inserting the slips 52 into the cavity 82 and connecting the slips 52 to the main body 50 with the fasteners 84. Once the slips 52 are positioned in the cavity 82, the setting ring 54 can be inserted into the bore of the body 50 and the retaining ring 94 can be connected to body 50 to prevent the setting ring 54 from falling out of the main body 50. As depicted in the present figures, one end of the setting ring 54 has a diameter smaller than that of a central opening in the retaining ring 94. This allows the setting ring 54 to extend through the retaining ring 94 and be engaged by the set pins 58. This arrangement also allows the setting ring 54 to move axially within the cavity 82 when the set pins 58 are retracted. The depicted setting ring 54 further includes an upper lip that is caught by the retaining ring 94 when the set pins 58 are retracted and the setting ring 54 drops to its second axial position.

In the presently illustrated embodiment, gravity causes the setting ring 54 and the slips 52 to move axially from their positions in FIG. 5 to their positions in FIG. 6 once the set pins 58 are retracted and no longer support the setting ring 54. But in other embodiments, one or more springs could be provided (e.g., in the cavity 82) to bias the slips 52 and the setting ring 54 toward the well once the set pins 58 are retracted. In another embodiment, the setting ring 54 is omitted and the slips 52 are provided at the end of the bore of the main body 50 so that the set pins 58 directly engage the slips 52, pushing them up into the cavity 82 when the cartridge is installed and letting them drop into engagement about the tubular string 74 when the pins 58 are retracted.

The cartridge 48 described herein can be installed in a wellhead 14 (e.g., in the tubing head 26) before additional components, such as the blowout preventer 16 and the injector head 18, are coupled to the wellhead 14. In one embodiment, assembly of the system 10 includes installing the cartridge 48 in the wellhead 14 and coupling the blowout preventer 16 to the wellhead 14 above the cartridge 48. Of course, such coupling could include connecting the blowout preventer 16 to the wellhead 14 via one or more intermediate members, such as an adapter spool. The injector head 18 can be coupled above the blowout preventer 16 to enable coiled tubing 20 to be run into the well 12 as the tubular string 74 that passes through the blowout preventer 16, the cartridge 48, and the wellhead 14.

When sufficient coiled tubing 20 has been run into the well, the coiled tubing 20 can be cut above the cartridge 48 (e.g., by shear rams of the blowout preventer 16). The set pins 58 can then be retracted to cause the setting ring 54 to move to the position depicted in FIG. 6. This in turn causes the slips 52 to contract inwardly and grip the coiled tubing string, as described above. The inner seals 68 can then be energized to seal against the coiled tubing string and inhibit leakage between the coiled tubing string and the cartridge 48. In this manner, the coiled tubing string (or some other tubular string) can be run into the well through the blowout preventer 16, the slips 52 can be set, and the seals of the assembly energized, all without removing the blowout preventer 16 or the injector head 18 from the wellhead 14. Further, once installed, the seals of the assembly (e.g., seals 64 and 68) can be pressure tested prior to removing the injector head 18 or the blowout preventer 16 from the wellhead 14.

The presently disclosed embodiments allow installation of the coiled tubing string and pressure testing of its seals without breaking the blowout preventer or injector head connections to the rest of the wellhead stack. This is in contrast to previous grapple-based systems in which a connection below the injector head would be broken after the coiled tubing string had been run into the well to allow grapples to be installed on the coiled tubing string to aid in hanging the coiled tubing string within a wellhead. Further, the presently disclosed technique allows proper well control to be maintained throughout the process of running a coiled tubing string into the well, setting the coiled tubing string with slips, sealing about the coiled tubing string, and testing the seals of assembly. This is in contrast to prior attempts that rely on a work window below the injector head to allow an operator to set slips against the coiled tubing through the window, as well as to cut the coiled tubing and then install a packoff through the window. Further, while the cartridge 48 can be installed in a tubing head 26 for hanging a coiled tubing string as described above, in other embodiments the cartridge 48 could be installed in some other wellhead spool besides the tubing head 26 and could be used to hang other things (e.g., other tubular strings) in a well.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system comprising:

a wellhead assembly spool attached to a well; and a cartridge having a body for installation within the wellhead assembly spool, the cartridge including slips and a setting ring that are disposed within a bore of the body, wherein the slips and the setting ring are retained within the bore of the body and are axially movable within the body such that, when installed within the wellhead assembly spool, the slips are retained in a retracted position when the setting ring is in a first axial position within the body and the slips contract inwardly when the setting ring is moved to a second axial position;

wherein the wellhead assembly spool includes at least one set pin extending into a bore of the wellhead assembly spool so as to retain the setting ring in the first axial position and the slips in the retracted position when the cartridge is installed in the wellhead assembly spool.

2. The system of claim 1, wherein the slips are disposed within a tapered cavity such that, when installed within the wellhead assembly spool, the tapered cavity biases the slips inwardly when the setting ring is moved to the second axial position.

3. The system of claim 1, wherein the at least one set pin can be retracted to allow gravity to move the setting ring from the first axial position to the second axial position so as to cause the slips to contract inwardly.

4. The system of claim 1, wherein the cartridge is installed within the wellhead assembly spool and a tubular string is installed through the bore of the body of the cartridge.

5. The system of claim 4, wherein the cartridge includes outer seals that enable sealing between the cartridge and the wellhead assembly spool and inner seals that enable sealing between the cartridge and the tubular string.

6. The system of claim 4, wherein the tubular string includes a coiled tubing string.

7. The system of claim 1, wherein the cartridge includes a retaining ring coupled to the body to retain the setting ring within the bore of the body of the cartridge.

8. The system of claim 1, wherein the slips include fasteners that connect the slips to the body of the cartridge.

9. The system of claim 1, wherein the at least one set pin extends radially through the wellhead assembly spool into the bore of the wellhead assembly spool and can be pulled from the bore of the wellhead assembly spool to allow gravity to move the setting ring from the first axial position to the second axial position so as to cause the slips to contract inwardly.

10. A system comprising:

a cartridge having a body for installation within a wellhead spool attached to a well, the cartridge including slips and a setting ring that are disposed within a bore of the body, wherein the slips and the setting ring are retained within the bore of the body and are axially movable within the body such that, when installed within the wellhead spool, the slips are retained in a retracted position when the setting ring is in a first axial position within the body and the slips contract inwardly when the setting ring is moved to a second axial position;

wherein the cartridge includes a retaining ring coupled to the body to retain the setting ring within the bore, and wherein a portion of the setting ring has a smaller diameter than that of an opening of the retaining ring to enable the portion of the setting ring to extend outwardly from the body through the opening of the retaining ring.

11. A system comprising:

a wellhead installed at a well;

a cartridge installed within a bore of the wellhead, wherein the cartridge includes: a hollow body, slips positioned within the hollow body to support a tubular string within the well, outer seals to seal against the wellhead, inner seals to seal against the tubular string, and an actuating ring positioned within the hollow body below the slips to support the slips within the cartridge and to enable movement of the actuating ring with respect to the hollow body and toward the well to cause the slips to close about the tubular string.

12. The system of claim 11, comprising the tubular string.

13. The system of claim 11, wherein the wellhead includes a tubing spool and the cartridge is installed within a bore of the tubing spool.

14. The system of claim 11, comprising a blowout preventer coupled to the wellhead.

15. The system of claim 14, comprising an injector head coupled to the blowout preventer to enable the tubular string to be run into the well through the blowout preventer, the cartridge, and the wellhead.

16. A method comprising:

landing a cartridge on a pin within a spool;

inserting a tubular string into a well through the cartridge within the spool; and retracting the pin in the spool to cause slips within the cartridge to radially contract and engage the tubular string so as to enable the tubular string to be suspended within the well via the slips.

17. The method of claim 16, wherein inserting the tubular string into the well through the cartridge includes inserting the tubular string through a wellhead assembly including a wellhead having the spool, a blowout preventer coupled to the wellhead, and an injector head coupled to the blowout preventer.

18. The method of claim 17, comprising running the tubular string into the well and then setting the slips against the tubular string without removing the blowout preventer or the injector head from the wellhead assembly.

19. The method of claim 18, wherein retracting the pin in the spool to cause the slips within the cartridge to radially contract includes causing a setting ring to move from a first position to a second position to allow the slips within the cartridge to radially contract.

* * * * *